US006702127B2

(12) United States Patent
Primiano

(10) Patent No.: US 6,702,127 B2
(45) Date of Patent: Mar. 9, 2004

(54) DISPLAY TRACK DEVICE WITH ANTI-TORSION FRONT CYLINDER

(75) Inventor: Bernard Primiano, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/350,438

(22) Filed: Jan. 24, 2003

(65) Prior Publication Data

US 2003/0168420 A1 Sep. 11, 2003

Related U.S. Application Data

(63) Continuation-in-part of application No. 10/284,788, filed on Oct. 31, 2002, which is a continuation-in-part of application No. 10/095,277, filed on Mar. 11, 2002, now Pat. No. 6,604,638.

(51) Int. Cl.[7] ..... A47F 7/00

(52) U.S. Cl. ..... 211/59.2; 211/74; 211/183; 312/72

(58) Field of Search ..... 211/59.2, 74, 183, 211/59.3, 175, 189; 312/45, 72

(56) References Cited

U.S. PATENT DOCUMENTS

| | | | | | |
|---|---|---|---|---|---|
| 4,238,022 | A | * | 12/1980 | Williams | 193/32 |
| 4,598,828 | A | * | 7/1986 | Young et al. | 211/59.2 |
| 5,024,336 | A | | 6/1991 | Spamer | 211/59.2 |
| 5,240,126 | A | * | 8/1993 | Foster et al. | 211/59.3 |
| 5,351,838 | A | | 10/1994 | Flum | 211/59.2 |
| 5,531,336 | A | * | 7/1996 | Parham et al. | 211/183 |
| 5,634,564 | A | | 6/1997 | Spamer et al. | 211/59.3 |
| 5,645,176 | A | | 7/1997 | Jay | 211/59.2 |
| 5,665,304 | A | * | 9/1997 | Heinen et al. | 312/71 |
| 5,685,664 | A | * | 11/1997 | Parham et al. | 403/393 |
| 5,695,074 | A | * | 12/1997 | Wiese | 211/59.2 |
| 5,706,957 | A | * | 1/1998 | Hardy | 211/59.2 |
| 5,788,091 | A | * | 8/1998 | Robertson et al. | 211/59.2 |
| 5,904,256 | A | | 5/1999 | Jay | 211/59.2 |
| 5,971,204 | A | * | 10/1999 | Apps | 221/92 |
| 6,068,139 | A | * | 5/2000 | Brozak, Jr. | 211/59.2 |
| 6,068,142 | A | | 5/2000 | Primiano | 211/183 |
| 6,082,556 | A | | 7/2000 | Primiano et al. | 211/59.2 |
| 6,142,316 | A | * | 11/2000 | Harbour et al. | 211/59.2 |
| 6,189,734 | B1 | * | 2/2001 | Apps et al. | 221/193 |
| 6,237,784 | B1 | | 5/2001 | Primiano | 211/59.2 |
| 6,325,221 | B2 | | 12/2001 | Parham | 211/59.2 |
| 6,513,667 | B2 | * | 2/2003 | Battaglia et al. | 211/59.2 |
| 2001/0002658 | A1 | * | 6/2001 | Parham | 211/59.2 |
| 2001/0020606 | A1 | * | 9/2001 | Battaglia et al. | 211/59.2 |

* cited by examiner

*Primary Examiner*—Daniel P. Stodola
*Assistant Examiner*—Jennifer E. Novosad
(74) *Attorney, Agent, or Firm*—John L. James

(57) ABSTRACT

A merchandising display shelf track device for receiving a row of articles for sliding movement therealong has non-planar front face members connected to a base wall and top stop members. Racking forces exerted on the top stop members and front face members are transferred through the non-planar face members to the base wall to minimize racking.

20 Claims, 6 Drawing Sheets

DISPLAY TRACK DEVICE WITH ANTI-TORSION FRONT CYLINDER

CROSS-REFERENCE TO RELATED APPLICATIONS

This application is a continuation-in-part of application Ser. No. 10/284,788 filed Oct. 31, 2002, and a CIP to application Ser. No. 10/095,277 filed Mar. 11, 2002, now U.S. Pat. No. 6,604,638.

TECHNICAL FIELD OF THE INVENTION

This invention relates to a track device for a merchandising display shelf, and, more particularly, to a gravity feed track device for articles on the shelf, particularly bottles, to slide along.

BACKGROUND OF THE INVENTION

A display rack unit is assembled from multiple track devices for merchandising articles such as bottled or canned drink products. The display rack unit may include a plurality of elongated track devices detachably interconnected in side-by-side relationship at adjacent sidewalls forming channels for beverage containers to slide along. It is common for adjacent channels to share a common sidewall to conserve space in the cooler. The number of track devices used to assemble the display rack unit is determined such that the overall size of the unit is suitable for placement onto an existing display shelf in a retail environment to fill the width of the shelf. A single retail installation for dispensing canned or bottled beverages can have hundreds of individual channels.

When manufacturing display track devices, cost is a factor, as well as appearance. To reduce material, and thereby material cost, adjacent tracks share a common sidewall, and the sidewalls as well as other members are formed with openings or voids. Sidewalls can be made thinner to conserve material, but thinner sidewalls tend to be flimsy which is undesirable. Strengthening ribs can be formed in the sidewalls to improve rigidity, but ribs effectively increases sidewall thickness thereby requiring more cooler space. The sidewalls, particularly at the front of the display track, have a tendency to spread apart. During use, a track device experiences forces that not only tend to cause the spreading of the sidewalls, but also causes racking the entire display track. Racking is the tendency of one component, which, when subjected to a force, to stress other components thereby distorting the display track causing the display track device to malfunction or break. Racking is a twisting of the structure. Increasing component thickness cures racking and spreading but is undesirable because the increased bulk increases manufacturing costs and lacks the desired aesthetics.

For the retail environment, not only are thinner walls desired, but an unobscured view of the product label in the display track as well. Such constraints have led to the use of an upper cross member at the top front of the track device to bridge the sidewalls or front structure. U.S. Pat. No. 6,325,221 (Parham), U.S. Pat. No. 6,237,784 (Primiano) and U.S. Pat. No. 5,645,176 (Jay) disclose track devices with a cross member.

The upper bridging cross member connects at each end to a sidewall or face panel to prevent spreading and reduce racking. Unfortunately, cross members are susceptible to breaking, with subsequent spreading, when a container is carelessly removed. Accordingly, it will be appreciated that it would be highly desirable to have a display track device that conserves material, resists racking and spreading, and maintains structural integrity when a container is removed.

SUMMARY OF THE INVENTION

The present invention is directed to overcoming one or more of the problems set forth above. Briefly summarized, according to one aspect of the present the invention, a longitudinally extending base wall has first and second opposed side edge portions laterally spaced from one another and a front extension forming a bottom support for a lead article. A first upstanding sidewall has a bottom portion connected to the first side edge portion of the base wall, a free top portion, and a front end portion extending between the top and bottom portions. A first face member has a top end portion, a bottom end portion and a longitudinal opening extending vertically between the top and bottom end portions. The first face member is connected to the front end portion of the first sidewall and to the base wall. The first face member extends laterally a preselected distance from the first sidewall in a direction toward the second side edge portion. The first face member is laterally non-planar to increase racking resistance. A second face member upstanding from the second side edge portion of the base wall has a top end portion, a bottom end portion and a longitudinal opening extending vertically between the top and bottom end portions. The second face member extends laterally a preselected distance toward the first sidewall. The second face member is laterally non-planar to increase racking resistance.

Curving the face panels increases torsion resistance so that the lead article does not rack the track device when it contacts the stop members or face members. The curved panels increase structural strength so that thinner material can be used without compromising strength thereby allowing a more expensive material, such as polymethlmethacrylate for example, to be used without increasing cost. Providing an opening in the face members saves material without compromising structural integrity and racking resistance. A narrow bottom portion of the face members increases the viewing window making product identification easier.

According to another aspect of the invention, there is a second upstanding sidewall having a bottom portion connected to the second side edge portion of the base wall, a free top portion, and a front end portion extending between the top and bottom portions. A second face member having a top end portion, a bottom end portion and a longitudinal opening extending vertically between the top and bottom end portions is connected to the front end portion of the second sidewall and to the base wall. The second face member extends laterally a preselected distance from the second sidewall in a direction toward the first sidewall. The second face member is laterally non-planar to increase racking resistance.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
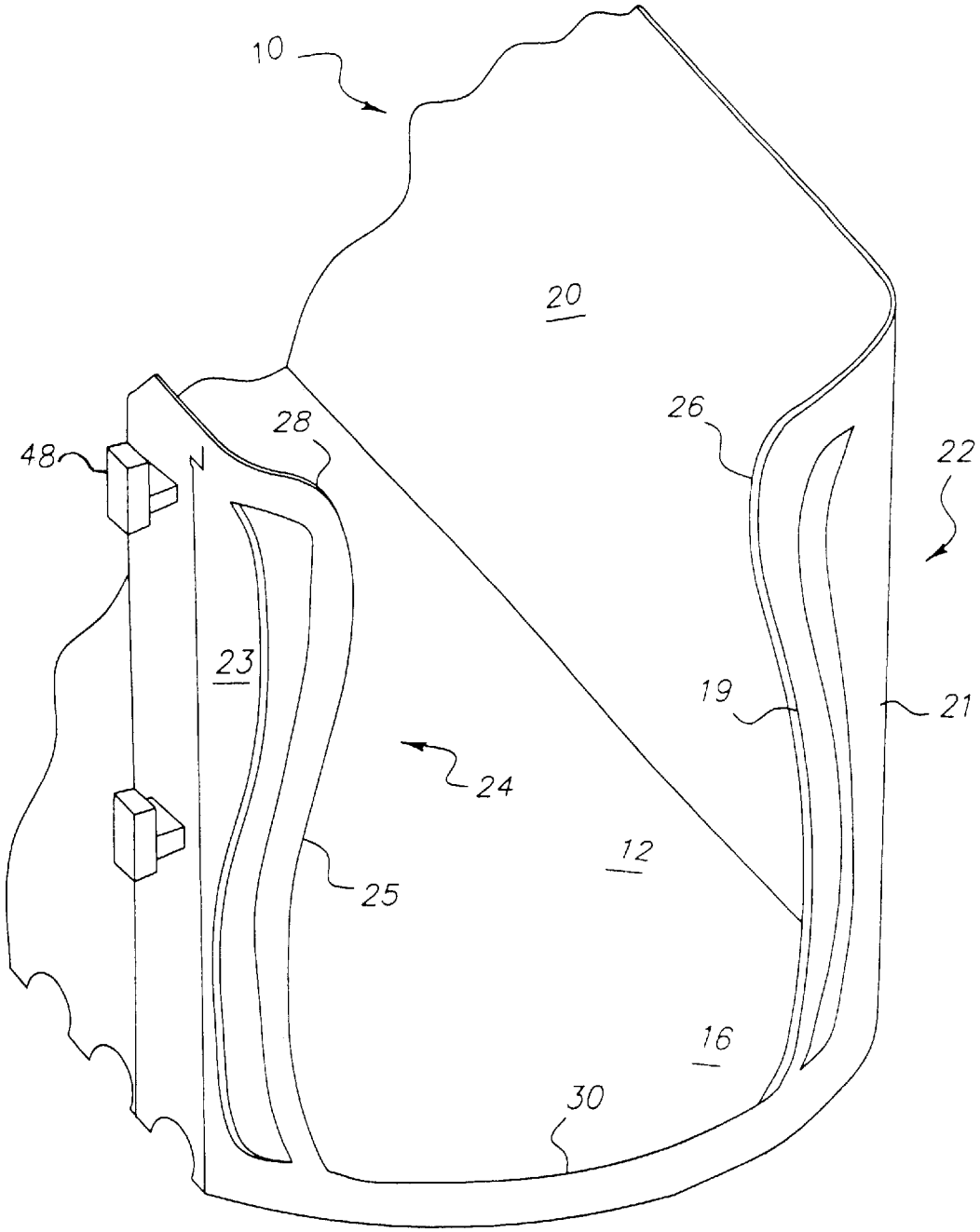
FIG. 1 is a perspective view of a preferred embodiment of a display track device incorporating an anti-torsion front according to the present invention.

Referring to FIG. 1, a merchandising display shelf track device 10 for receiving a row of articles for sliding movement therealong is illustrated. Such a track device is more fully illustrated and described in co-pending application Ser. No. 10/284,788 filed Oct. 31, 2002, the disclosure of which is incorporated herein by reference. A display rack unit is typically assembled from multiple track devices and is designed to merchandise articles such as bottled or canned beverage products. One common form of a display rack unit includes a plurality of elongated track devices detachably interconnected in side-by-side relationship. The exact number of track devices used to assemble the display rack unit is determined such that the size of the unit is suitable for placement onto an existing display shelf in a retail environment. The interconnection of two adjacent track devices is conventionally achieved by connecting means such as connector slots cooperating with L-shaped horizontal connector elements. Details of such track devices and connector elements are more fully described in U.S. Pat. No. 5,634,564, which issued Jun. 3, 1997 to Spamer et al., the disclosure of which is incorporated herein by reference.

The longitudinally extending base wall 12 has first and second opposed side edge portions laterally spaced from one another and front extension 16 forming a bottom support for the lead article. Preferably, front extension 16 is curved to fit the contour of the circumference of the container that it supports which is believed to be more aesthetically pleasing than a mismatch between the container and the extension. Of course, while a front extension that is dimensionally smaller than the container bottom would work, in practice, it is not practical because not every member of the consuming public is careful when removing a container from a display track device. While the container is easily removed by-lifting, sometimes a consumer pushes downward on the container with sufficient force to rupture the container due to the mismatch between the container bottom and front extension. It is therefore desirable that the front extension be of larger diametrical dimension than the container to prevent rupture when a consumer pushes downward on the container.

Figure 5:
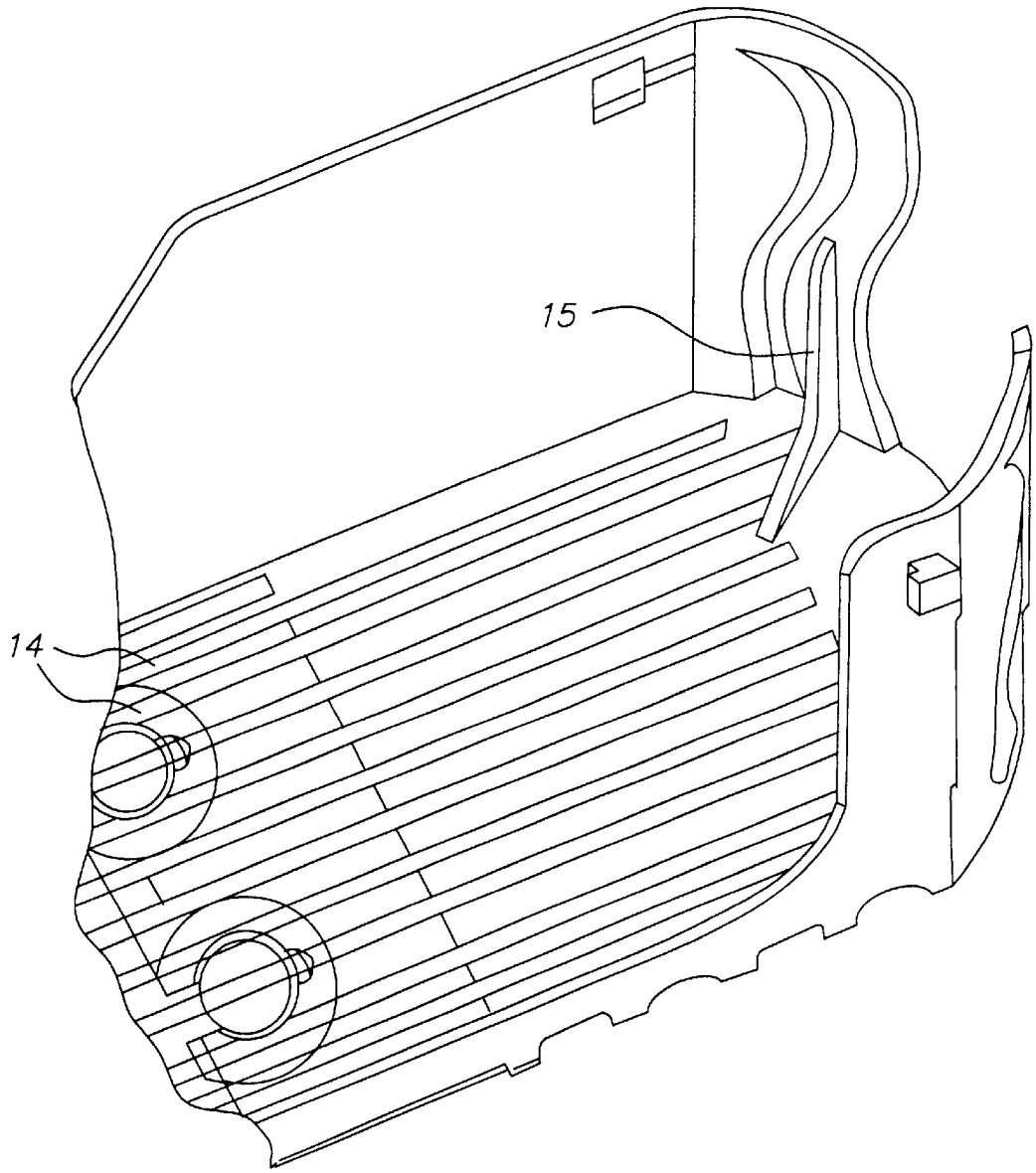
FIG. 5 is a perspective view of another preferred embodiment of a display track device, similar FIG. 1, incorporating rising ribs at the front.
Figure 6:
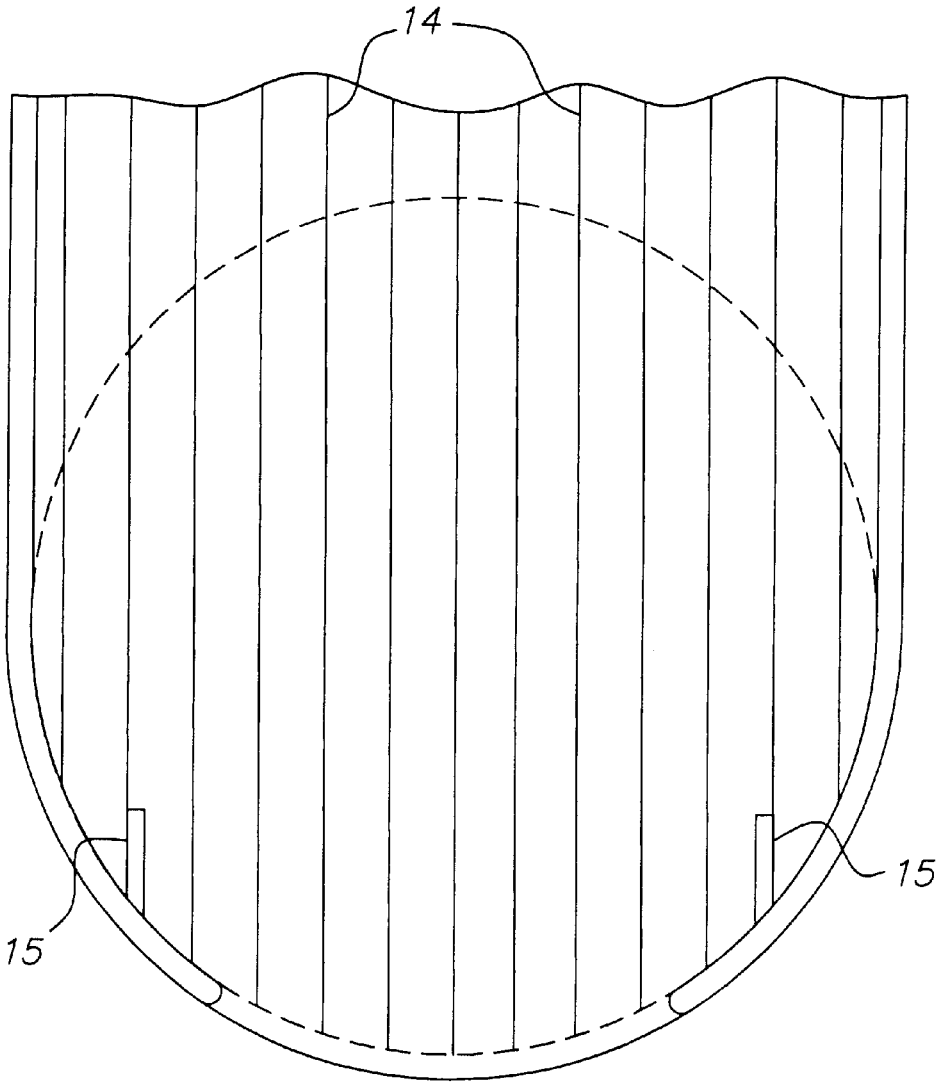
FIG. 6 is a diagrammatic top view of the display track device of FIG. 5.

Parallel ribs 14 are effective in reducing friction, however, sometimes friction is reduced to such an extent that the container develops too much downward speed for the structure which can cause tipping or other undesirable effects. To slow the downward speed, the number of parallel ribs may be reduced on the front extension or may be eliminated completely. Similarly, on the forward most portion of the base wall 12 behind the front extension 16, the number of friction reducing ribs is sometimes reduced or eliminated completely. Alternatively, some or all of parallel ribs 14 may have a riser panel or ramp 15 at the front to slow the downward speed (FIGS. 5 and 6). Such riser panels for reducing speed of an article sliding along the track are more fully described in application Ser. No. 10/095,277 filed Mar. 11, 2002, the disclosure of which is incorporated herein by reference.

Panels 15 may be arranged in pairs with one panel on either side of the longitudinal centerline of the track device. The front end of each panel 15 may be attached to a corresponding face panel and is preferably integrally formed with a rib and the face panel. Integral formation strengthens the structure and helps prevent racking.

A first upstanding sidewall 20 has a bottom portion connected to the first side edge portion of the base wall 12, and has a free top portion. By free top portion it is meant that the top portion is free of connection to another sidewall or members connecting sidewalls. The first sidewall 20 also has a front end portion that extends between the top and bottom portions at the front of the sidewall and the track device.

A first face panel assembly 22 is connected to the first sidewall 20. Face panel assembly 22 has top and bottom end portions and is preferably connected, not only to the front end portion of sidewall 20, but to base wall 12, or more, preferably the front extension 16 of base wall 12 as well. Face panel assembly 22 has a longitudinal opening extending vertically between the top and bottom end portions that divides face panel assembly 22 into left and right panels 19, 21. Left and right panels 19, 21 preferably define an S-shaped opening. First face panel 22 is connected to the front end portion of first sidewall 20 and to base wall 12. The first face panel assembly 22 extends laterally from sidewall 20 in a direction toward the second side edge portion of the base wall 12. The first face panel assembly 22 is laterally non-planar to increase racking resistance. By non-planar it is meant that the interior surface, and preferably the exterior surface, of face panel assembly 22 is not a flat panel but is curved. It may be formed of a number of contiguously interconnected flat panel sections or otherwise contoured to accommodate the configuration of a container placed therein. Being laterally non-planar means that, in the lateral direction which extends from one side edge or sidewall to the other, the interior surface of face panel assembly 22 departs from a line perpendicular to the side edges or sidewalls. In other words, when looking straight down on the structure, face panel assembly 22 is preferably arcuate relative to the perpendicular line.

By making face panel assembly 22 laterally non-planar, the torsional force required to twist the end portion of face panel assembly 22 is increased as well as the force required to bend face panel assembly 22 in the horizontal and transverse directions. In a three dimensional system, face panel assembly 22 has an X or transverse dimension, a Y or longitudinal dimension, and an Z or vertical dimension wherein one of the dimensions is zero. In the present invention, the dimensions of face panel assembly 22 can be considered as changing in the X and Y directions while remaining constant in the Z direction so that face panel assembly 22 resembles a curved room divider or wall panel sitting or standing on a floor that has its interior and exterior surfaces curved, but which does not curve in the vertical direction at all. Any curvature of face panel assembly 22 in the Z or vertical direction would change the relationship between the top and bottom stop members and is appropriate only when the relationship between the top and bottom stop members is taken into account.

Preferably, face panel assembly 22 has a larger lateral dimension along its top portion than along its bottom portion. Such construction halts forward motion of a container from while maximizing a window for viewing product labeling. Dividing face panel assembly 22 into left and right panels 19, 21 tends to increase the viewing area, and, more importantly, to draw attention to the viewing area. While only one longitudinal opening is shown, there could be more than one opening to provide a central bridging member between the left and right panels 19, 21 to thereby increase torsional strength and racking resistance while reducing material.

A second face panel assembly 24 is upstanding from the second side edge portion of base wall 12. Second face panel assembly 24 has top and bottom end portions with the bottom end portion preferably connected to base wall 12. Face panel assembly 24 has a longitudinal opening extending vertically between the top and bottom end portions that divides face panel assembly 24 into left and right panels 23, 25. Left and right panels 23, 25 define a reverse S-shaped opening which is a mirror image of the opening defined by left and right panels 19, 21 of the first face panel assembly 22. Second face panel assembly 24 extends laterally a preselected distance towards first sidewall 20 and is also laterally non-planar to increase its racking resistance. When taken together, face panel assemblies 22 and 24 form an arc of a circle the diameter of which is slightly greater than the diameter of the container that slides along the track device. Because containers are designed to hold either a certain quantity of beverage and/or have certain physical dimensions, the diameter of a particular container can be ascertained. Accordingly, track devices can be manufactured for a particular container. The result is that there is not an infinite number of container diameters to consider. There is a finite number of container diameters to consider, so that only a relatively small number of curvatures of the face panel are required to accommodate most container dimensions.

In addition to forming an attractive front for the track device, the face panels are also functional. They halt the forward movement of the lead container in the track. As the containers are gravity fed from the rear of the track device toward the front, they experience acceleration and acquire speed and momentum. The center of gravity for a container does not lie on the bottom of the container but at some interior mid-portion of the container. To help keep the container from tipping over, along with the face panels, first and second top stop members 26, 28 are provided.

Top stop member 26 connects the top portions of the left and right panels 19, 21 of the first face panel assembly 22. Top stop member 28 connects the top portions of the left and right panels 23, 25 of the second face panel assembly 24.

Preferably, top stop members 26 and 28 lie above the center of gravity of the container but may lie below the center of gravity of the container depending upon whether the top stop members 26, 28 are contacted first by the container, or whether a bottom stop member 30 is first contacted by the container. Bottom stop member 30 is preferably connected to the front extension 16 of the base wall but may be connected to the bottom end portions of the first and second face panels 22, 24 as well.

When bottom member 30 is first contacted by the container, forward momentum carries the center of gravity forward in a direction tending to tip over the container in which instance it is desirable to have the top stop members 26, 28 above the center of gravity so that there is no danger of tipping. However, because the center of gravity of the container is in the interior space of the liquid filled container, the center of gravity shifts as the liquid moves. Because the center of gravity lies within the interior of the container, the top stop members may be positioned below the center of gravity without danger of the container tipping over. The exact vertical positioning of the top stop members is not only dependent on the center of gravity of the container as it slides down the track but also upon the particular configuration of the container. This is so because a beverage container is filled with liquid which shifts when the forward motion of the container ceases abruptly causing the center of gravity to shift.

The shift in the center of gravity, and therefore the tendency to tip over, depends upon the amount liquid, the amount of free space, and the configuration of the container. Thus, a container filled with a volume of liquid with air space above the liquid will experience a certain amount of shift in the center of gravity which can be taken into account when positioning the top stop members. It is desirable that the top stop members not only prevent the container from tipping over but also prevent the container from lifting any portion of its bottom off the base wall. These constraints can be met when the top stop members are positioned above the center of gravity for the container and the containers do not experience free fall when sliding down the track.

Preferably, the first and second face panels 22, 24 each have a larger lateral dimension along its bottom portion than along its top portion, not only for aesthetic appeal, but to prevent a container from being removed from the track device by its bottom. In conventional structures, removal by the bottom provides an opportunity for breaking the cross member joining the sidewalls causing the structure to rack and fail.

The first and second top stop members 26, 28 do not form a continuous top cross member that bridges sidewalls or front structure of the display track device. Their function is to help halt forward motion of the lead container to prevent tipping. Because the first and second top stop members are not an integral unit but are separated and not physically connected laterally, they cannot and do not prevent the sidewalls, face panels or front structure of the track device from spreading. In fact, the present invention, because of the non-planar configuration of the face members acts an anti-torsion device that impedes torsional, and therefore racking, forces exerted on either the top stop members or the bottom stop member when the lead container impacts them from being transferred through the face members to the other of the top and bottom stop members. In effect, the non-planar configuration of the face members and their physical connection to the sidewalls, base wall and stop members enables them to absorb or distribute forces to thereby reduce racking.

Figure 3:
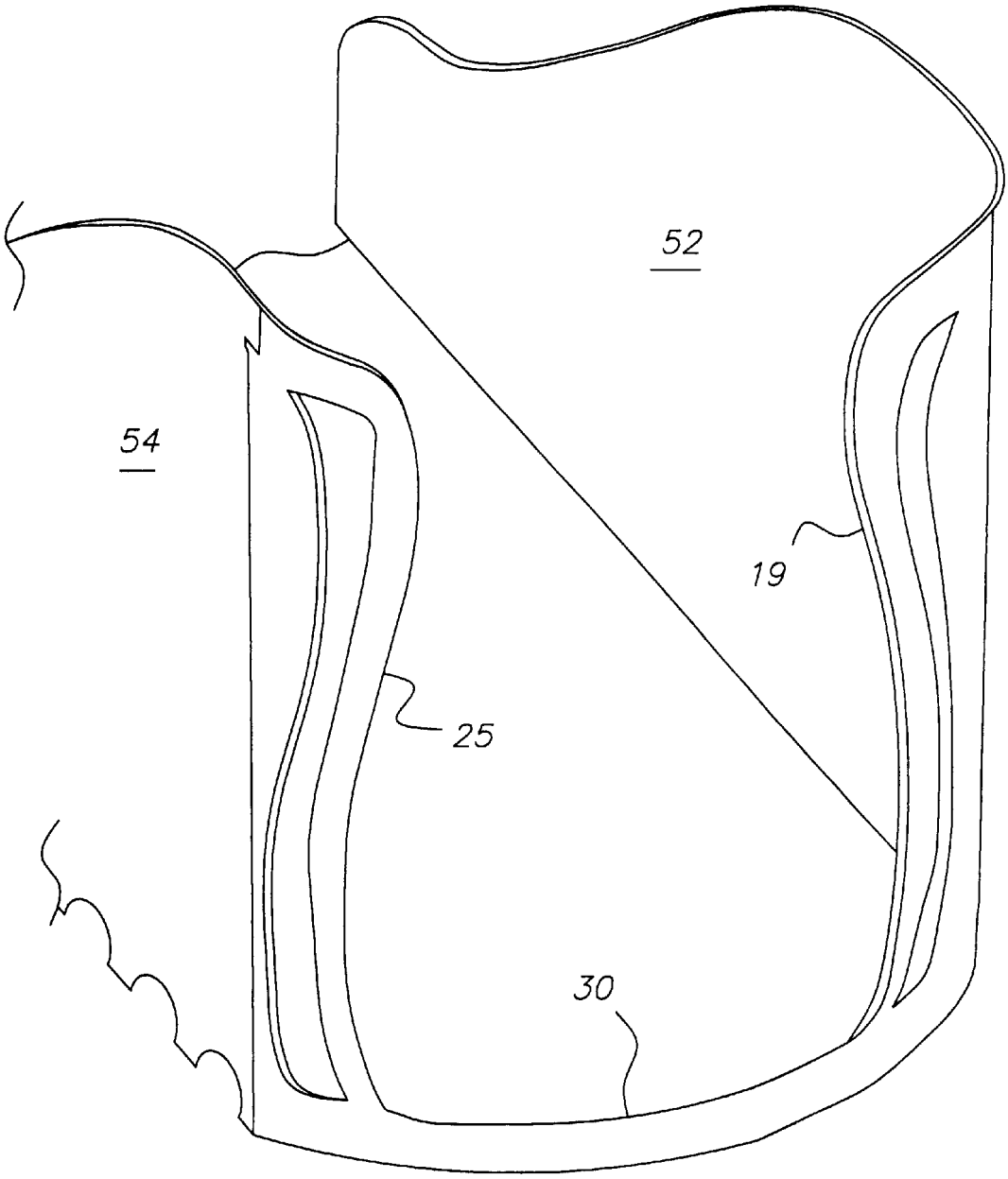
FIG. 3 is a perspective view similar to FIG. 1 but with two permanently attached sidewalls.
Figure 4:
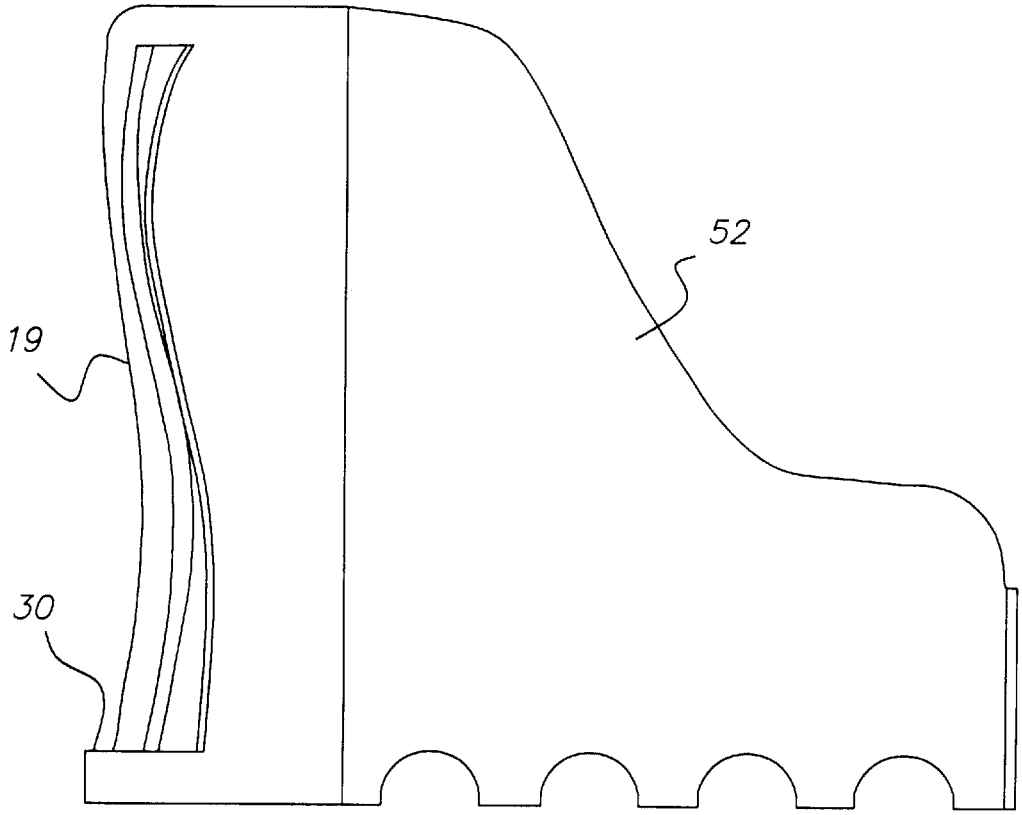
FIG. 4 is a right side view of the display track device of FIG. 3.

When a beverage container contacts the face member 22, 24, the axial or longitudinal force of the container results in an outward or transverse force tending to spread the face members and an axial or longitudinal force tending to stretch the face members along the longitudinal axis of the track. The curved structure of the face members resists torsion and transfers the force to the base wall to which they are connected. When filled with beverage containers, there is no possibility that the base wall will move or distort to cause racking. FIG. 3 illustrates front face members integrally formed with sidewalls of the track device forming a curvilinear structure that is of uniform wall thickness.

Again referring to FIG. 1, the track device includes means for removably attaching a second sidewall which is preferably one or a plurality of L-shaped or T-shaped lugs 48 extending from the side of the second face member 24. The first face member 22 has openings 50 to receive lugs so that display track devices can be connected side-by-side. Where there is only one track device, a sidewall can be attached to the track device using the lugs 48.

Figure 2:
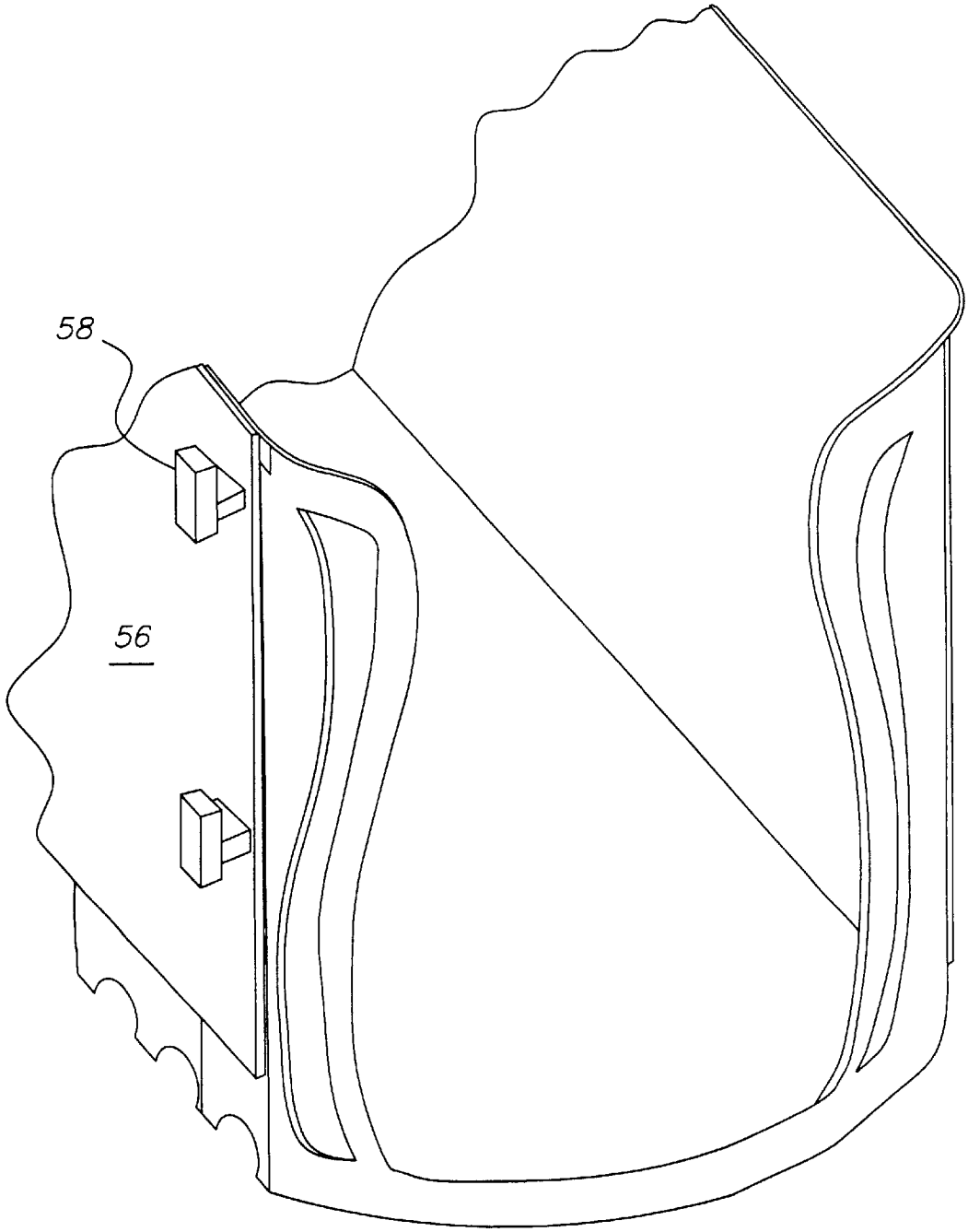
FIG. 2 is a perspective view similar to FIG. 1 but with a detachable sidewall attached.

FIG. 3 illustrates a display track device with two sidewalls 52, 54 permanently connected. This configuration allows different width track devices to be placed side by side on a shelf to accommodate different sizes of containers without assembly. They are simply placed next to one another on a shelf making them convenient to use for smaller coolers where several different products are displayed. The sidewalls 52, 54 are taller in the front of the track device than at the rear giving them a flowing contour that saves material and makes the beverage containers more visible in the track. FIG. 2 illustrates a display track device with a removable sidewall 56 attached by lugs 58.

It can now be appreciated that a merchandising display shelf track device has a non-planar columnar face panel that adds rigidity to the structure. When the top stop member is integrally formed with the columnar member that is attached to the base wall, particularly the front extension of the base member, the result is a structure that mimics an aircraft to resist racking. A force exerted against the top stop member in the direction of the longitudinal axis of the base member, and therefore the display track device, also acts against the columnar structure and the front extension of the base member. The effect is that the force is met with a much stiffer resistance than if the columnar member were not present or if the columnar member were planar. The result is less racking, and if the top stop member were continuous from one face member to the other, the racking would not be severe enough to break the top cross member under normal intended use. This is very different from conventional structures wherein racking can become so severe that the top cross member fractures.

Racking and fracture are very real problems that are somewhat addressed by reducing the number of friction reducing ribs at the front extension and front portion of the base wall so that the beverage container slows in both speed and acceleration as it nears the front stop members. When used, the riser panels also slow the speed of the beverage container as it nears the front stop members. In conventional structures, when a front cross member fractures or fails, partial disassembly of the structure is required and reassembly is necessary to replace broken components when possible, otherwise, the structure is ruined and must be replaced. The increased cost per pound of polycarbonate material over polypropylene or other commonly used materials is justified by the increased rigidity and clarity of the polycarbonate material. It is to be remembered that a driving force in changes in display track devices is reduced cost and ease of brand recognition by limiting the amount of structure that obscures both the product and the product labeling.

Again referring to the analogy between the structure and an aircraft, the structure can be likened to an aircraft wherein the top stop members mimics the wings of an aircraft, the columnar member mimics the fuselage of the aircraft, and the front extension of the base wall or the base wall itself mimics the tail section of the aircraft. In such an analogy, the racking of the top stop members is inhibited by the connection of the columnar members to the base wall, just as the fuselage resists torsion between the wings and tail section of an aircraft. If the base member is considered stationary, which is generally the case because its movement is limited by the weight of the containers, then the racking movement of the top stop members is limited also.

While the invention has been described with particular reference to the preferred embodiments, it will be understood by those skilled in the art that various changes may be made and equivalents may be substituted for elements of the preferred embodiments without departing from invention. For example, while contoured sidewalls have been described with regard to fixed sidewalls, contours can be used with removable sidewalls as well.

As is evident from the foregoing description, certain aspects of the invention are not limited to the particular details of the examples illustrated, and it is therefore contemplated that other modifications and applications will occur to those skilled in the art. For example, while components are illustrated as solid, they could be perforated to conserve material and promote air circulation. It is accordingly intended that the claims shall cover all such modifications and applications as do not depart from the true spirit and scope of the invention.

What is claimed is:

1. A first merchandising display shelf track device adapted to receive articles for sliding movement therealong, comprising:

a longitudinally extending base wall having first and second opposed side edge portions laterally spaced from one another and a front extension forming a bottom support for a lead article;

a first upstanding sidewall having a bottom portion connected to said first side edge portion of said base wall, a free top portion, and a front end portion extending between said top and bottom portions;

a first face member having a top end portion, a bottom end portion and a longitudinal opening extending vertically between said top and bottom end portions, said first face member being connected to said front end portion of said first sidewall and to said base wall, said first face member extending laterally a preselected distance from said first sidewall in a direction toward said second side edge portion, said first face member being laterally non-planar to increase racking resistance; and a second face member upstanding from said second side edge portion of said base wall and having a top end portion, a bottom end portion and a longitudinal opening extending vertically between said top and bottom end portions, said second face member extending laterally a preselected distance toward said first sidewall, said second face member being laterally non-planar to increase racking resistance.

2. A merchandising display shelf track device, as set forth in claim 1, wherein said first and second face members each have a laterally curved surface.

3. A merchandising display shelf track device, as set forth in claim 1, wherein said first and second face members each have a larger lateral dimension along the top portion than along the bottom portion.

4. A merchandising display shelf track device, as set forth in claim 1, wherein said longitudinal opening of said first face member divides said first face member into left and right panels, and wherein said longitudinal opening of said second face member divides said second face member into left and right panels.

5. A merchandising display shelf track device, as set forth in claim 4, including:

a first top stop member connecting a top portion of said left panel and a top portion of said right panel of said first face member; and a second top stop member connecting a top portion of said left panel and a top portion of said right panel of said second face member, said first and second top stop members being separate from one another.

6. A merchandising display shelf track device, as set forth in claim 1, including a bottom member connected to said front extension of said base wall.

7. A merchandising display shelf track device, as set forth in claim 1, including a plurality of parallel ribs extending along said base wall, at least two ribs of said plurality of ribs each having a riser panel attached thereto.

8. A merchandising display shelf track device, as set forth in claim 1, including means for removably attaching a second sidewall, said second sidewall having an opening, said means including an L-shaped lug extending from said second face member to protrude through said opening.

9. A merchandising display shelf track device, as set forth in claim 1, including:

a second merchandising display shelf track device; and means for connecting said first and second merchandising display shelf track devices in side by side relation to thereby receive two rows of article for sliding movement therealong.

10. A merchandising display shelf track device, as set forth in claim 9, wherein said connecting means connects said first and second merchandising display shelf track devices along face members thereof.

11. A first merchandising display shelf track device adapted to receive articles for sliding movement therealong, comprising:

a longitudinally extending base wall having first and second opposed side edge portions laterally spaced from one another and a front extension forming a bottom support for a lead article;

a first upstanding sidewall having a bottom portion connected to said first side edge portion of said base wall, a free top portion, and a front end portion extending between said top and bottom portions;

a second upstanding sidewall having a bottom portion connected to said second side edge portion of base wall, a free top portion, and a front end portion extending between said top and bottom portions;

a first face member having a top end portion, a bottom end portion and a longitudinal opening extending vertically between said top and bottom end portions, said first face member being connected to said front end portion of said first sidewall and to said base wall, said first face member extending laterally a preselected distance from said first sidewall in a direction toward said second sidewall, said first face member being laterally non-planar to increase racking resistance; and a second face member having a top end portion, a bottom end portion and a longitudinal opening extending vertically between said top and bottom end portions, said second face member being connected to said front end portion of said second sidewall and to said base wall, said second face member extending laterally a preselected distance from said second sidewall in a direction toward said first sidewall, said second face member being laterally non-planar to increase racking resistance.

12. A merchandising display shelf track device, as set forth in claim 11, wherein said first and second face members each have a laterally curved surface.

13. A merchandising display shelf track device, as set forth in claim 11, wherein said first and second face members each have a larger lateral dimension along the top portion than along the bottom portion.

14. A merchandising display shelf track device, as set forth in claim 11, wherein said longitudinal opening of said first face member divides said first face member into left and right panels, and wherein said longitudinal opening of said second face member divides said second face member into left and right panels.

15. A merchandising display shelf track device, as set forth in claim 14, including:

a first top stop member connecting a top portion of said left member and a top portion of said right member of said first face member; and a second top stop member connecting a top portion of said left member and a top portion of said right member of said second face member, said first and second top stop members being separate from one another.

16. A merchandising display shelf track device, as set forth in claim 11, including a bottom member connected to said front extension of said base wall.

17. A merchandising display shelf track device, as set forth in claim 11, including a plurality of parallel ribs extending along said base wall, at least two ribs of said plurality of ribs each having a riser panel attached thereto.

18. A merchandising display shelf track device adapted to receive a row of articles for sliding movement therealong, comprising:

a longitudinally extending base wall having first and second opposed side edge portions laterally spaced from one another and a front extension forming a bottom support for a lead article;

a first upstanding sidewall having a bottom portion connected to said first side edge portion of said base wall, a free top portion, and a front end portion extending between said top and bottom portions;

a first face member having a top end portion, a bottom end portion and a longitudinal opening extending vertically between said top and bottom end portions, said longitudinal opening of said first face member dividing said first face member into left and right panels, said first face member being connected to said front end portion of said first sidewall and to said base wall, said first face member extending laterally a preselected distance from said first sidewall in a direction toward said second side edge portion, said first face member curving laterally to increase resistance to racking; and a second face member upstanding from said second side edge portion of said base wall and having a top end portion, a bottom end portion and a longitudinal opening extending vertically between said top and bottom end portions, said longitudinal opening of said second face member dividing said second face member into left and right panels, said second face member extending laterally a preselected distance toward said first sidewall, said second face member curving laterally to increase resistance to racking; and a second upstanding sidewall having a bottom portion, a free top portion, and a front end portion extending between said top and bottom portions, said second sidewall being detachably connected along said front end portion to said second face member.

19. A merchandising display shelf track device, as set forth in claim 18, wherein said first and second face members each have a larger lateral dimension along the top portion than along the bottom portion.

20. A merchandising display shelf track device, as set forth in claim 18, including:

a first top stop member connecting a top portion of said left panel and a top portion of said right panel of said first face member; and a second top stop member connecting a top portion of said left panel and a top portion of said right panel of said second face member, said first and second top stop members being separate from one another.

* * * * *